US005275297A

United States Patent [19]

Dokoupil et al.

[11] Patent Number: 5,275,297

[45] Date of Patent: Jan. 4, 1994

[54] CLIP-ON BOOK SUPPORT AND LABEL HOLDER

[75] Inventors: James Dokoupil, Liverpool, N.Y.; Nolan Lushington, Norwalk, Conn.; Gregory Mt. Pleasant, Baldwinsville, N.Y.

[73] Assignee: The Croydon Company, Inc., Liverpool, N.Y.

[21] Appl. No.: 987,162

[22] Filed: Dec. 8, 1992

Related U.S. Application Data

[63] Continuation of Ser. No. 643,654, Jan. 16, 1991, Pat. No. Des. 331,599.

[51] Int. Cl.[5] ..... A47F 5/00

[52] U.S. Cl. ..... 211/184; 108/61; 211/43

[58] Field of Search ..... 211/184, 43; 108/60, 108/61

[56] References Cited

U.S. PATENT DOCUMENTS

| | | | |
|---|---|---|---|
| 691,628 | 1/1902 | Hoffman et al. | 211/184 |
| 903,769 | 11/1908 | Poindexter | 211/184 |
| 1,806,642 | 5/1931 | Ohnstrand | 108/61 |
| 3,780,876 | 12/1973 | Elkins | 211/184 |
| 3,921,811 | 11/1975 | Dameron | 211/43 |
| 4,327,838 | 5/1982 | Cooke | 211/184 |
| 5,072,835 | 12/1991 | Price, Jr. et al. | 211/40 |
| 5,217,124 | 6/1993 | Stone | 211/184 |

*Primary Examiner*—Robert W. Gibson, Jr.
*Attorney, Agent, or Firm*—Katherine McGuire

[57] ABSTRACT

A book support of the clip-on type including a label holder having at least one transparent label viewing surface which may releasably engage to the front wall of the book support in covering, spaced relation thereto. In a preferred embodiment of the invention, the label holder includes two planar label viewing surfaces which lie in orthogonally oriented planes. When attached to the front wall of the book support, the label holder and front wall form a substantially triangular transverse cross-section. A label having shelf-identifying indicia printed thereon may be removably inserted between the label holder and the front wall of the book support for viewing through the label holder viewing surfaces. The indicia is printed twice in symmetrical arrangement on the label such that the indicia appearing through the first label viewing surface is the same indicia that appears through the second label viewing surface. As such, the shelf-identifying indicia is displayed about a large viewing angle of at least 180°. The large viewing angle proves especially useful to person perusing down consecutive aisles of book shelves in that the person need not have to stand directly in front of the book support to see the label.

6 Claims, 3 Drawing Sheets

CLIP-ON BOOK SUPPORT AND LABEL HOLDER

REFERENCE TO RELATED APPLICATION

This application is a continuation of design application Ser. No. 07/643,654 filed on Jan. 16, 1991, now U.S. Pat. No. 0,331,599.

BACKGROUND OF THE INVENTION

This application relates to book supports and, more particularly, to a book support of the type which clips onto the forward edge of a shelf. The book support further includes novel label holder and viewing means providing at least two vertically and orthogonally oriented, transparent viewing windows.

Clip-on book supports are known in the art and comprise an upper, book-contacting support structure with a clip projecting rearwardly from the bottom front portion of the book-contacting support structure. The book support is attached to a shelf upon which books are positioned in the conventional vertically oriented, cover-to-cover arrangement. The clip of the book support engages the forward edge of the shelf with the upper book-contacting structure firmly resting upon the shelf in an up-right, standing position by the clip. The book support is selectively positioned upon the shelf with the book-contacting structure thereof firmly abutted against the exposed cover of the end book of a stack of books. The book-contacting structure provides a laterally directed force against the end book thereby preventing the books from falling over on the shelf. An example of such a book support may be seen in U.S. Pat. No. 4,327,838 issued to Cooke on May 4, 1982.

SUMMARY OF THE INVENTION

It is a principal object of the present invention to provide a book support with label display means which displays shelf-identifying labels.

It is a further object of the present invention to provide a book support with label display means which displays shelf-identifying labels about a large viewing angle.

It is another object of the present invention to provide a book support and label display means which provide transparent viewing surfaces arranged at an angle relative to the forward facing wall of the book support thereby providing direct readability of the label to a person situated a significant lateral distance to either side of the book support.

It is yet a further object of the present invention to provide a clip-on book support with label display means which allows for quick and easy interchangability of a plurality of various labels within the label display means.

It is yet another object of the present invention to provide a clip-on book support with label display means of the above type in which the label display means is easily and quickly removably attachable to the book support.

Other objects will in part be obvious and in part appear hereinafter.

In accordance with the foregoing objects, the invention comprises a book support of the clip-on type which includes an upper, book-contacting structure with a clip integrally formed and extending rearwardly from the forward end of the bottom wall of the book-contacting structure. The book-contacting structure comprises a rigid framework of generally rectangular outline formed of molded plastic and includes a bottom wall, top wall, front wall and rear wall. As mentioned above, the clip is integrally formed at the forward end of the bottom wall, substantially adjacent the front wall, forming a space between the clip and bottom wall wherein the forward edge of a book shelf is inserted. The clip is biased in a direction toward the bottom wall and firmly yet removably engages the book support to the shelf.

When mounted upon a shelf, the front wall of the book-contacting structure is vertically oriented, extending in a direction substantially perpendicular to the shelf. The bottom wall lies in contacting, covering relation to the top surface of the shelf upon which the books are stacked. The rear wall extends upwardly from the back portion of the bottom wall and bends toward the top portion of the front wall. A top wall extends between and interconnects the top of the rear wall to the top of the front wall. Each of the front, rear, top and bottom walls are of substantially constant width, the walls having contiguous first and second side edges with the first side edge of the book-contacting structure lying in a plane spaced and parallel to the second side edge. Depending on whether the book support is mounted to the right or left of a stack of vertically oriented books, the first or second edge of the book-contacting structure is firmly abutted against the exposed or outwardly facing cover of the end book.

When mounted upon a book shelf in the intended manner, the bottom wall of the book-contacting structure extends toward the rear edge of the shelf in a direction substantially perpendicular to the longitudinal length of the shelf. The front and rear walls of the book-contacting structure extend upwardly and substantially perpendicular to the bottom wall with the top wall interconnecting the front and rear walls thereby forming a generally rectangular configuration as aforementioned. As such, the book-contacting support, specifically the first or second edge thereof, abuts the end book cover over a large surface area thereof, thereby providing a large lateral force against the end book substantially preventing the book from falling over.

Turning discussion toward the label display means of the book support, the front wall of the book-contacting support includes a substantially planar front surface which lies in a plane substantially perpendicular to the plane in which the bottom wall of the book support lies. A pair of laterally spaced, parallel flanges traverse the front surface of the front wall in longitudinally extending relationship thereto. The flanges are generally L-shaped with the terminal edges thereof projecting toward and lying parallel, slightly spaced and closely adjacent the first and second, longitudinal side edges of the front wall. The first and second flanges thus form first and second, longitudinally extending channels with the front surface of the front wall. A ledge is integrally formed at the bottom of the front wall extending substantially perpendicular thereto and extending laterally from side edge to side edge thereof. The ledge provides a stop for the label holder portion of the label display means which slidingly engages the pair of flanges on the front wall.

In particular, the label holder is molded, extruded or otherwise formed as one piece from a transparent material such as clear plastic. The label holder is elongated and in the most preferred embodiment, is configured with two integral and orthogonally oriented, longitudinally extending label viewing surfaces. The longitudinal, terminal edges of the holder bend inwardly toward each other to form third and fourth, parallel flanges which slidably engage within the channels formed by the first and second flanges on the front wall, respectively.

As mentioned above, the label holder itself is entirely transparent and, when engaged to the front surface of the front wall, forms a substantially triangular transverse cross-section with the front wall with the longitudinal apex of the label holder lying substantially spaced and parallel to the central, longitudinal axis of the front wall. A label is inserted behind the label holder which is inscribed with shelf-identifying indicia which, in the intended manner, is inscribed twice in side-by-side, longitudinally aligned relationship. The label is creased along its central, longitudinal axis which divides the label and the double printed, shelf-identifying indicia into symmetrical, longitudinal halves. Each half of the label is of the same cross-dimensions, and thus surface area, of the label holder label viewing surfaces. Since the label holder is open at both ends, the label may thus be inserted immediately behind the label viewing surfaces in covering relation thereto. The first and second halves of the label are thus clearly seen through the first and second viewing surfaces of the label holder, respectively.

The invention thus provides a book support and label holder in which the label holder displays a double shelf-identifying label at two orthogonally oriented angles relative to the book support. A person may therefore clearly view the label from either the right or left of the book support, for example, when quickly perusing down an aisle when looking for a particular shelf and without having to walk down the aisle.

DETAILED DESCRIPTION

Figure 1:
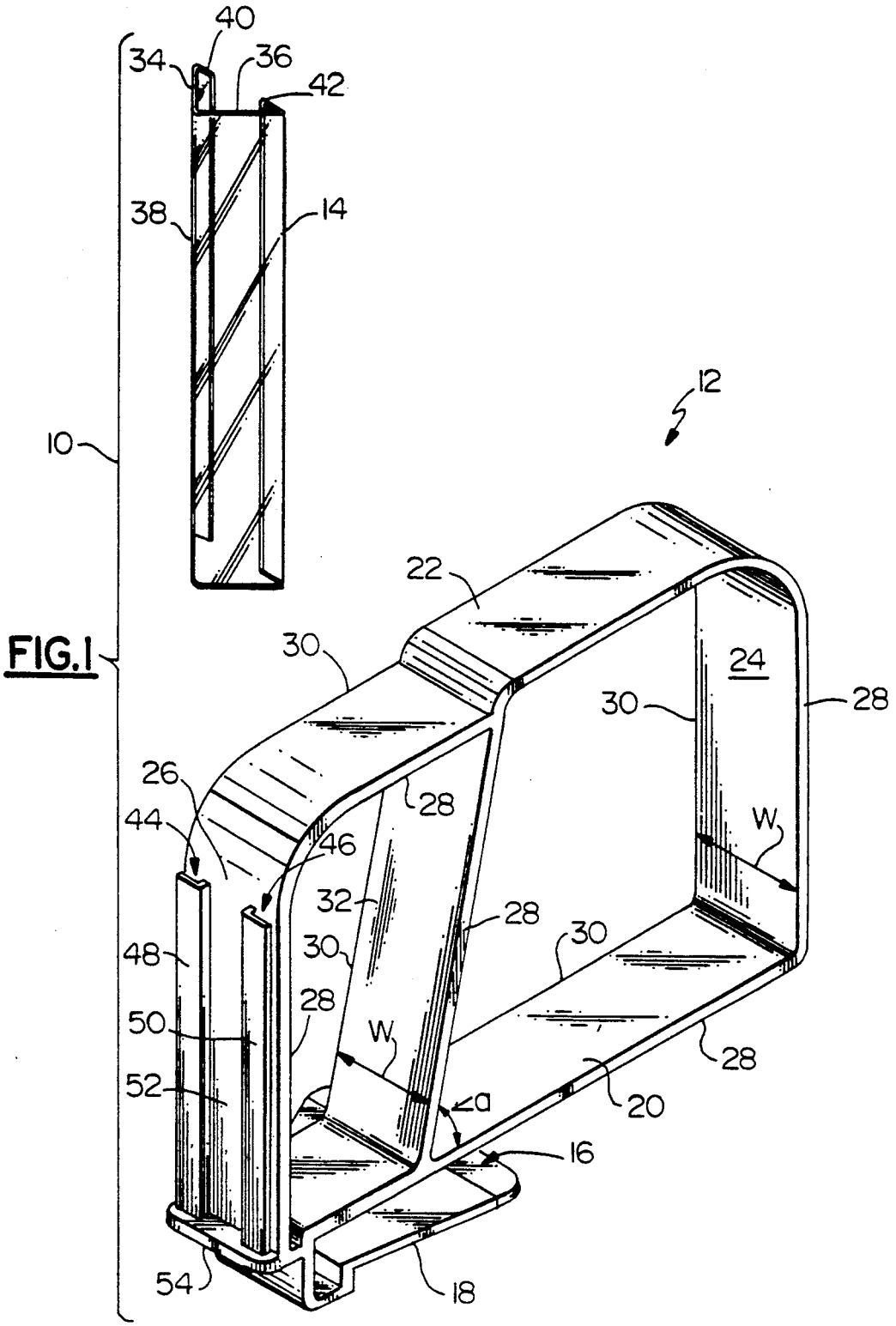
FIG. 1 is a perspective view of a preferred embodiment of the book support and label display showing the transparent label holder in spaced relation above the front wall of the book support.

Referring now to the drawings, there is seen in the various Figures a book support designated generally by the reference numeral 10 including book-contacting structure 12 and label holder 14. Book support 10 removably attaches to a book shelf (not shown) by engaging the forward edge of the shelf in the space 16 formed between the clip 18 and bottom wall 20 of book-contacting structure 12 in the usual manner of mounting book supports of the shelf clip-on type.

Figure 2:
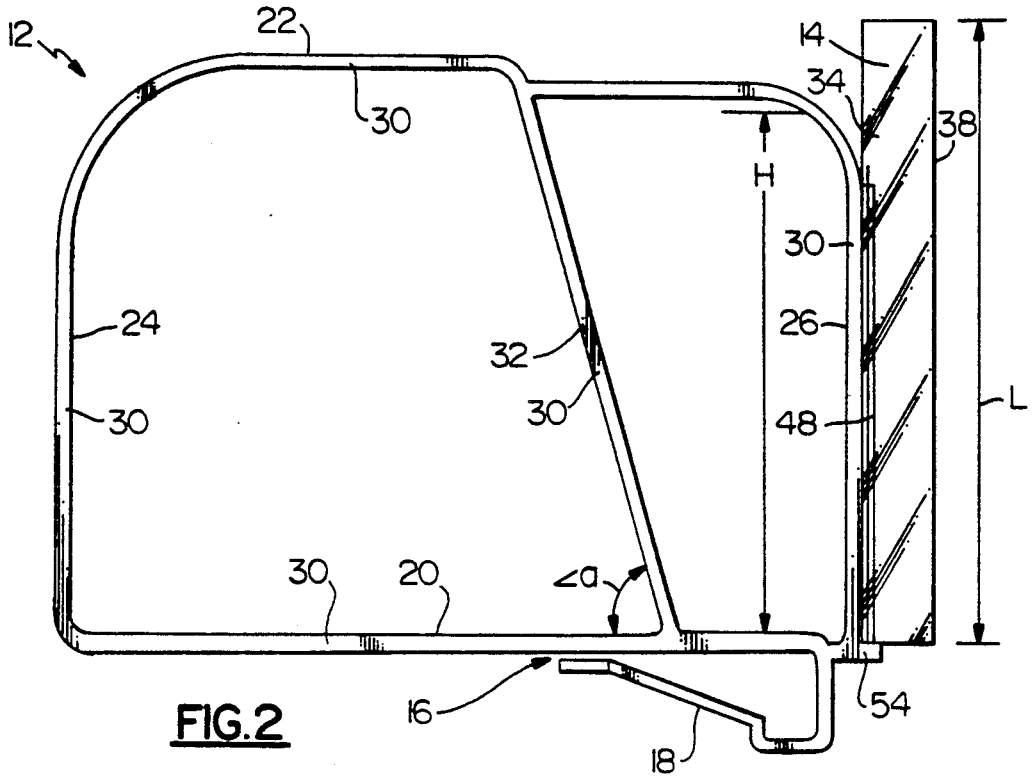
FIG. 2 is a side elevational view of the book support and label display showing the transparent label holder attached to the front wall of the book support in the intended manner.

Referring first to book-contacting structure 12, it is seen that structure 12 is formed entirely of one piece, having a bottom wall 20, top wall 22, rear wall 24 and front wall 26. Structure 12 is rigid and preferably formed from molded plastic. Each of the bottom, top, rear and front walls 20, 22, 24 and 24, respectively, are of substantially the same width W, having continuous, first and second side edges 28 and 30, respectively, which lie in spaced, parallel planes to each other. When mounting book support 10 to a shelf, edge 28 and/or 30 are firmly abutted against the exposed cover of the end book of a stack of vertically oriented books (also not shown). It will be noticed that book-contacting structure 12 further includes an angled cross member 32, also having a continuous width W, which extends from bottom wall 20 to top wall 22 at an acute angle "a" (FIGS. 1 and 2). Cross member 28 also includes side edges 28 and 38 thus providing additional support against the exposed cover of an end book.

Figure 6:
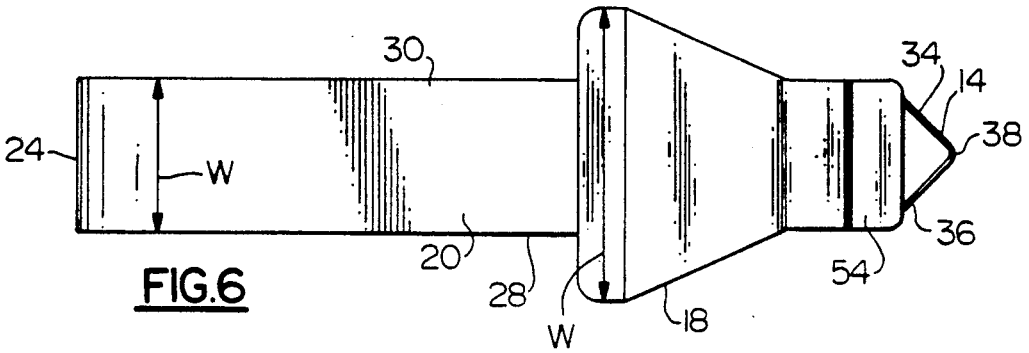
FIG. 6 is a bottom plan view thereof.
Figure 3:
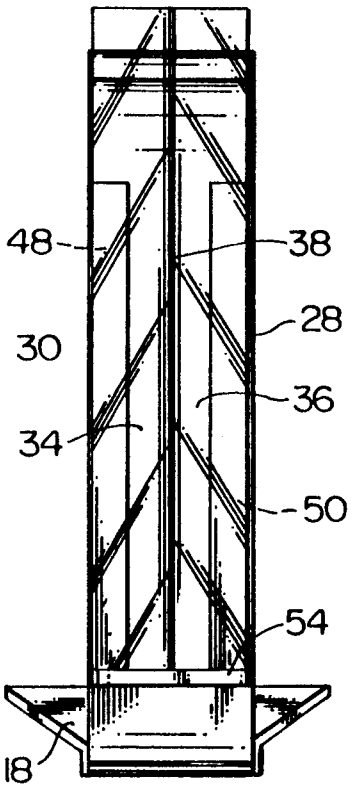
FIG. 3 is a front elevational view thereof.
Figure 4:
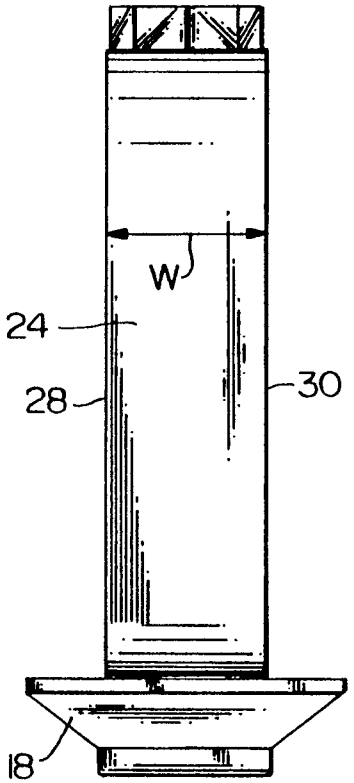
FIG. 4 is a rear elevational view thereof.

Clip 18 integrally extends downwardly, and then rearwardly and gradually upwardly from the forward end of bottom wall 20. Clip 18 tapers outwardly as it extends rearwardly toward rear wall 24, having a terminal width w larger than width W of bottom wall 20 (FIG. 6), thereby providing a large surface area and secure grip upon a shelf.

Referring now to the label display, label holder 14 is seen to be formed as one piece of transparent plastic in the general shape of an elongated triangle. More specifically, holder 14 includes first and second, longitudinally extending, planar viewing surfaces 34 and 36 arranged orthogonally relative to each other about a central, longitudinal apex 38. Holder 14 further includes first and second, inwardly turned, co-planar flanges 40 and 42. Flanges 40 and 42 slidingly engage within longitudinal channels 44 and 46 formed by L-shaped flanges 48 and 50, respectively, which traverse front surface 52 of front wall 26. A ledge 54 is integrally formed at the bottom of front wall 26 and extends in a direction substantially perpendicular thereto. Further, ledge 54 extends lengthwise from side edge 28 to side edge 30 and forms a stop for label holder 14. As seen best in FIG. 2, the length L of label holder 14 is longer than the height H of front wall 26, with label holder 14 extending upwardly from ledge 54 to a position above top wall 22. A label longer than the height H of front wall 26 may thus be used with label holder 14 which provides great flexibility in choosing and using a desired book classification scheme.

Since label holder 14 is symmetrical, either end thereof may be inserted into channels 44 and 46. A presumably paper label having substantially the same surface area and cross dimensions as the total surface area and cross dimensions of viewing surfaces 34 and 36 is easily inserted into holder 14. This may be quickly accomplished by folding the paper label (not shown) along a central, longitudinal axis and inserting one end thereof immediately behind viewing surfaces 34 and 36 in contacting, covering relation thereto. The label is thus positioned between the viewing surfaces 34 and 36, and label holder flanges 40 and 42. Since the label need not be gummed to be held in place within label holder 14, the label is removable and replaceable with other labels as desired. It is intended that the label be inserted in label holder 14 when label holder 14 is fully engaged in channels 44 and 46 (FIG. 2), however; it may also at times be desirable to position the label against viewing surfaces 34 and 36 when label holder is detached from front wall 26 (FIG. 1), with both label holder 14 and the label simultaneously attached to front wall 26 in the manner described above.

Figure 5:
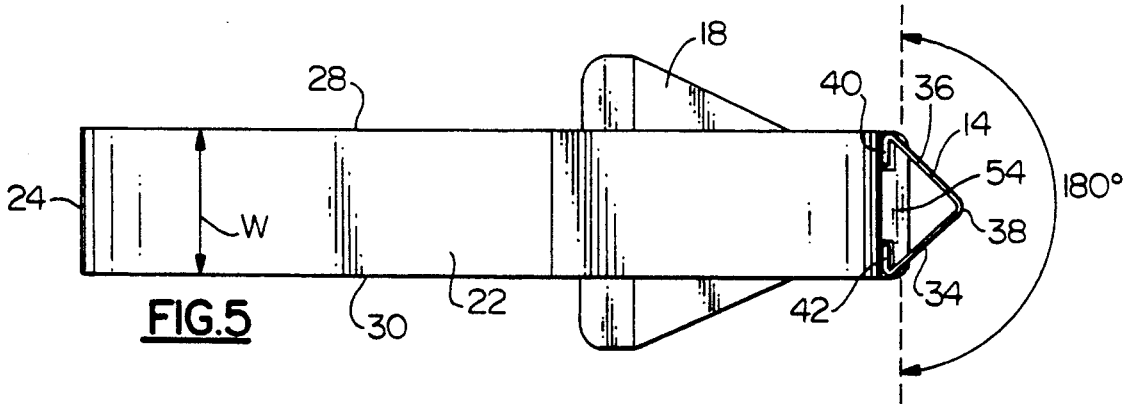
FIG. 5 is a top plan view thereof.

As mentioned earlier, the label is printed with shelf-identifying indicia appearing twice, one longitudinally parallel to the other. As such, the shelf-identifying indicia will appear through both viewing surfaces 34 and 36. As can be appreciated by looking at the plan view of FIG. 5, the orthogonal arrangement of viewing surfaces 34 and 36 provide a substantially 180° viewing angle to a passerby. This is especially useful to a person quickly looking down an aisle of successive book shelves so that they do not have to walk down the aisle to see the shelf label.

Although the invention has been described with particular reference to a preferred embodiment thereof, it will be appreciated to those skilled in the art that various changes and modifications may be made to the invention without departing from the full spirit and scope thereof as is defined by the claims which follow.

What is claimed is:

1. A book support for abutting and maintaining at least one book vertically upright when said book support and book are positioned in side-by-side relationship upon a shelf having a front edge and a substantially planar shelf surface, said book support including label display means for removable insertion and viewing of a label having shelf-identifying indicia imprinted thereon, said book support comprising:

a) a rigid book-contacting structure including means for removably and firmly mounting said book-contacting structure to said shelf with said book-contacting structure positioned upon and extending across said planar shelf-surface in a direction away from said front edge, said book-contacting structure further including a front wall having a front surface facing away from said shelf, and first and second side edges, said front wall extending substantially perpendicularly upwardly from said planar shelf surface adjacent said front edge when said book-contacting structure is attached to said shelf; and said label display means comprising:

b) a label holder attached to said front surface of said front wall of said book-contacting structure, said label holder including at least one transparent, label viewing surface lying in covering, spaced relation to said front surface, whereby a label having shelf-identifying indicia imprinted thereon may be positioned between said front surface and said label viewing surface with said indicia being visible through said label viewing surface.

2. The invention according to claim 1 wherein said label holder and said front wall include cooperative attachment means providing for the removable attachment of the former to the latter.

3. The invention according to claim 2 wherein said front wall first and second side edges are parallel and said label holder includes first and second, integrally formed said planar, transparent, label viewing surfaces with said first and second label viewing surfaces being elongated and longitudinally extending in orthogonal planes relative to each other thereby defining at their juncture a central, longitudinal apex, said label holder and said front wall generally forming a triangular transverse cross-section when the former is attached to the latter, and whereby a label having first and second, identical indicia in longitudinally symmetrical arrangement imprinted thereon may be positioned between said first and second label viewing surfaces and said front surface of said front wall with said first and second identical indicia being visible through said first and second label viewing surfaces, respectively, with said label having a longitudinal axis lying parallel to and closely adjacent said longitudinal apex of said label holder.

4. The invention according to claim 3 wherein said front wall cooperative attachment means comprises first and second, elongated flanges traversing said front surface in spaced, parallel relation to each other and to said first and second side edges of said front wall, and wherein said label holder cooperative attachment means comprises third and fourth parallel, spaced flanges lying co-planar and extending toward each other from the edges of said first and second label viewing surfaces opposite said apex, said first and second flanges being L-shaped and forming first and second, elongated channels, said label holder removably slidingly engageable to said front wall by said third and fourth flanges of said label holder being slidingly inserted within said first and second channels of said first and second flanges, respectively.

5. The invention according to claim 4 and further comprising a stop formed at the portion of said front wall lying adjacent said shelf planar surface when said book support is attached thereto, said stop being operable to prevent said label holder from sliding past said portion of said front wall when said label holder is engaged to said front wall.

6. The invention according to claim 5 wherein said means mounting said book-contacting structure to said shelf comprises a clip formed adjacent said portion of said front wall and configured to releasably receive and engage said front edge of said shelf.

* * * * *